United States Patent [19]

Voorheis et al.

[11] 4,194,874

[45] Mar. 25, 1980

[54] VARIABLE FLAME SHAPE OIL BURNER

[75] Inventors: Temple S. Voorheis, Atherton; Louis D. Siegert, Burlingame, both of Calif.

[73] Assignee: Coen Company, Burlingame, Calif.

[21] Appl. No.: 866,746

[22] Filed: Jan. 3, 1978

[51] Int. Cl.[2] ..... F23C 5/00; F23Q 9/00; F23D 11/10

[52] U.S. Cl. ..... 431/8; 431/278; 239/423

[58] Field of Search ..... 431/278, 175, 8, 9; 239/549, 561, 423, 404, 433, 434

[56] References Cited

U.S. PATENT DOCUMENTS

| | | | |
|---|---|---|---|
| 1,947,755 | 2/1934 | Bucknam et al. | 431/278 X |
| 2,500,787 | 3/1950 | Lelgemann | 431/175 X |
| 2,933,259 | 4/1960 | Raskin | 239/423 X |
| 3,055,416 | 9/1962 | Marshall et al. | 431/175 X |
| 3,338,570 | 8/1967 | Zimmer | 239/549 X |
| 3,752,405 | 8/1973 | Vosper et al. | 239/413 |
| 3,775,038 | 11/1973 | Pillard | 431/278 X |

FOREIGN PATENT DOCUMENTS

| | | | |
|---|---|---|---|
| 2062593 | 6/1972 | Fed. Rep. of Germany | 431/278 |

*Primary Examiner*—Carroll B. Dority, Jr.
*Assistant Examiner*—Randall L. Green
*Attorney, Agent, or Firm*—Townsend and Townsend

[57] ABSTRACT

An oil fired burner adapted to produce a variable asymmetrical flame shape. The burner includes a tip head carrying a plurality of tips disposed in at least two orientations, i.e., axial and off-axis. The relative rates of fuel supply to the tips is controlled to afford asymmetric flame shaping. In a typical application in a rotary cement kiln, the flame is biased to increase the heat transferred to the load in the front end of the kiln and to decrease the heat transferred to the top and sides of the kiln.

9 Claims, 4 Drawing Figures

VARIABLE FLAME SHAPE OIL BURNER

BACKGROUND OF THE INVENTION

This invention relates to an oil burner that affords adjustment of the shape of the flame produced thereby in an asymmetric pattern.

In many burner applications, for example, in firing a rotary kiln, it is desirable to vary the flame pattern from time to time and to bias the shape of the flame in an asymmetric pattern. In the environment of a rotary kiln, variations in the constitution and feed rate of the raw materials fed into the kiln require variations in flame shape in order to achieve optimal operation.

Oil fired burners designed to produce variable flame shapes which are symmetrical in longitudinal cross section are known. An exemplary burner is described in U.S. Pat. No. 3,752,405 to Vosper et al. Therein, an oil burner is described having two separate, individually fed oil injection systems, one of which injects one or more narrow, axially directed oil streams, and the other of which injects one or more short, wide angle oil streams. The apparatus described in that patent is so arranged that the streams injected by the two systems intercept one another to form a symmetric composite stream which combusts in the form of a composite flame of variable "bushiness."

SUMMARY OF THE INVENTION

According to the invention, a variable flame shape oil burner for kiln and other applications produces a flame which is asymmetrical in longitudinal cross section. The flame produced thereby is biased to increase the heat transferred generally downwardly to the load in the kiln and to decrease the heat transferred to the top and sides of the kiln where the burner is aligned with the kiln axis. In specific embodiments, the burner can produce a flame which is biased to increase the heat transferred to the load at the front end of the kiln.

The burner according to the invention includes a tip head which is fabricated with a multiplicity of flame tips arranged in a predetermined pattern and at predetermined angles relative to a central axis. Specifically, there are provided so-called core tips, i.e., tips fed through the central or core supply line, which direct an axial fuel spray. The tip head further includes so-called annulus tips, i.e., tips fed through an annular coaxial supply line, which directs fuel spray at an angle with respect to an axial center line of the burner. The fuel sprays intersect to form a composite asymmetrical fuel spray. Each of the annulus tips is adapted to produce a spray cone angle of greater than about 70° and preferably about 80°. A spray cone angle of about 33° is used in the core tip heads. The wider spray angle has the effect of producing a softer spray with a smaller droplet size which results in a desirable localized heat "polishing" effect from the annulus tips without danger of actually stroking or "playing" on the load.

In a specific embodiment for use in a cement kiln, two wide angle annulus tips and three axially aligned core tips are provided. The wide angle annulus tips are disposed at about a 45° to 55° angle relative to the center line of the burner. The annulus tips are to be oriented at an angle generally directed toward the location of maximum load in the kiln.

Separately controllable fuel supplies are provided to the annulus tips and to the core tips. An asymmetric bushy portion of the flame can be directed toward the load by relative adjustment of the fuel supply rates.

The principal object of this invention is to provide a burner which is capable of producing any desired asymmetric flame shape between a long narrow flame at one extreme and a short wide bushy flame at the other extreme. This object at achieved by providing in close spaced relation two sets of individually fed nozzle tips disposed at compound angles and by means for varying the amount of fuel supplied to each of the nozzle tips.

A feature and advantage of the present invention is that the rate or the pressure at which the fuel is supplied to one or both of the nozzle tip sets can be varied in order to extend still further the range over which the flame shape can be varied.

Other objects, features and advantages of the present invention will be more apparent after referring to the following specification and accompanying drawings.

DETAILED DESCRIPTION OF PREFERRED EMBODIMENTS

Figure 1:
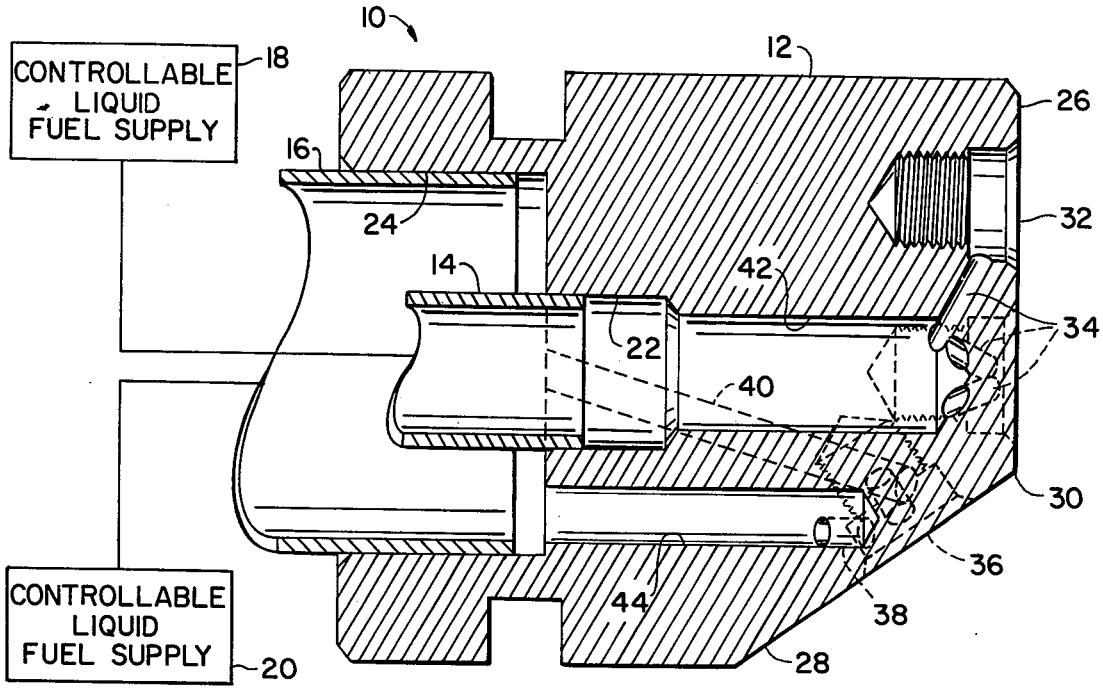
FIG. 1 is a front elevational view in partial cross section of a burner according to the invention.

Referring more particularly to the drawings, there is shown a burner assembly 10 having a tip head 12, a first fuel supply conduit for core feed 14, a second fuel supply conduit or annulus feed 16 concentric about the core feed 14, a first controllable liquid fuel supply 18 which is connected with core feed 14 and a second controllable fuel supply 20 which is connected to annulus feed 16.

As shown in FIG. 1, the tip head 12 is mounted to the core feed 14 and annulus feed 16 which mates with first and second concentric counterbores 22 and 24 in the tip head 12. The tip head 12 is generally cylindrical and includes a first face 26 which is generally perpendicular to a central axis of the tip head and a second face 28 at an obtuse angle to the first face 26. The second face 28 may be formed by cutting off one corner of the tip head 12 so that the first and second faces 26 and 28 share a common edge 30. The angle between the central axis through face 26 and an axis normal to face 28 is generally between about 40° and 70° and is preferably about 55°. In other words, the angle of the faces to one another along edge 30 is preferably about 235° (or 125°).

Figure 3:
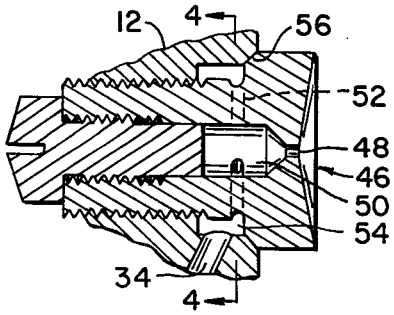
FIG. 3 is a side cross sectional view of a burner tip suitable for use in the device of FIG. 1.
Figure 2:
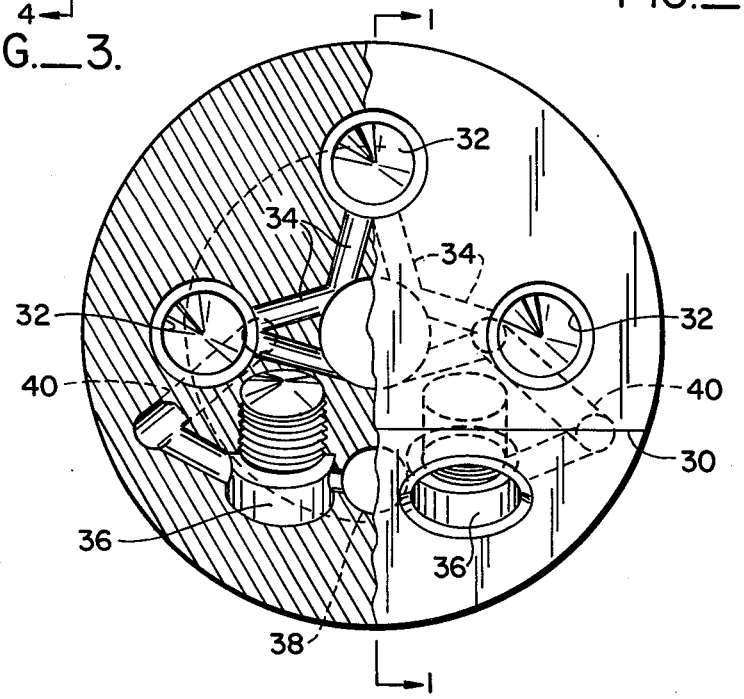
FIG. 2 is a side cross sectional view along line 2—2 of FIG. 1.

Referring now particularly to FIG. 2, it is seen that each face 26 and 28 includes a plurality of orifices therein. The orifices are threaded sockets adapted to receive spray tips, an example of which is shown in FIG. 3. The sockets in face 26 may be called core tip sockets 32 because they are adapted to mount a burner tip which received its fuel supply from core 14 through a plurality of conduits 34. The sockets in face 28 are called annulus tip sockets 36 because burner tips therein receive fuel from the annulus 16 through conduits 38 and 40.

In the preferred embodiment, the tip head 12 is bilaterally symmetric along a plane passing through the central axis. Three core tip sockets 32 are provided equidistant from the central axis in face 26. Two annulus tip sockets 36 are provided in the side face 28 which are also equidistant from the central axis although disposed in a divergent direction. A bore 42 and conduits 34 communicate between core 14 and core tip sockets 32. Annulus 16 communicates through a bore 44 and conduits 38 to core sockets 36 as well as through conduits 40. The respective conduits 34, 38, 40 open into the respective sockets 32, 36 through the side of a socket counterbore.

Figure 4:
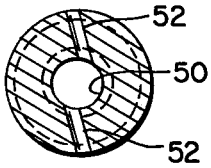
FIG. 4 is a cross sectional view along line 4—4 of FIG. 3.

The annulus tips are configured to generate a relatively broad spray of fuel whereas the core tips are configured to generate a relatively narrow spray. The construction of one such tip 46 is shown in FIG. 3. Each tip 46 has an axially directed outlet passage 48 that communicates with an inner chamber 50 disposed therebehind. The chamber 50 is supplied with fuel from one or more tangentially directed passages 52 which lead to an annular chamber 54 defined by the outer wall of the tip 46 and the counterbore of the socket. The tip 46 sealably rests on a countersink 56 of the socket. The tangential passages 52 are shown more clearly in the cross section of FIG. 4. The tips 46 in annulus sockets are adapted to form a short wide fuel stream by reducing the diameter of tangential passages 52 relative to the size of the axial passage 48. The spray cone angle of the annulus tips are for example, preferably chosen to be between 60° and 100° and particulary a spray cone angle of about 80° is optimal. Spray cone angles in this range produce a relatively soft spray with small droplet sizes as compared with narrower spray angles. The cone angle of core tips is generally chosen to be between about 30° and 40° and particularly an angle of about 33° is optimal. When used in a tip head according to the invention to form a composite flame spray, the tips produce surprising results as hereinafter explained.

The contemplated operation of the invention is within a kiln which has a load to be fired which extends generally longitudinally along the bottom of the cylindrical interior of the kiln. The tip head is disposed within the kiln at one end with its central axis generally parallel with a central axis of the kiln and with the side face 28 disposed with its edge 30 generally parallel to the surface of the load.

Fuel from the controllable liquid fuel supply 18 for the core tips is injected through the core conduit 14 into the core tips to produce a combustible spray parallel to the central axis. Similarly, fuel from the controllable liquid fuel supply 20 is injected into the annulus 16 and through the annulus tips to produce a bushy or relatively wide, fine combustible spray transverse and asymmetrically divergent from the central axis. This latter spray, being extremely fine because of the wide spray angle and its reduced fraction of the total oil capacity from all nozzles, is "picked up" by the primary air and provides an immediate total heat release into flame heat of all of its oil since the primary air stream is able to provide, with a small additional quantity of ingested secondary air as needed for 100% combustion, quickly and locally of the oil from each of the annulus tips. This combustion, barely visible as a heat "blister" on the lower part of main flame body, adjacent, i.e., toward the load, is available to provide the heat source for the localized load head "polishing" by radiant energy transfer according to Boltzmann's law.

Fuel flow to each of the tips may be changed by changing the pressure of liquid fuel supplied thereto, or if larger changes are required within the limits of acceptable atomization, tips of differing capacity may be substituted. Also the side face 28 may include tips skewed from the plane through the central axis to provide further asymmetric divergence.

EXAMPLE

One effect of the use of a burner head according to the invention has been observed in a wet process cement kiln. The core tips function to provide load preheating and calcination of the limestone in the calcining zone. The annulus tips provide a relatively short flame of variable bushiness which, together with the spray of the core tips, can produce a flame for heat "polishing" of the clinker just prior to its discharge from the kiln. Core tips and off axis annulus tips having spray cone angles of 33° and 80° respectively in a tip head according to the invention produce a relatively short hot flame. At normal operating pressures within the limits of good atomization, the liquid fuel does not "punch through" the primary air, but rather mixes intimately with the primary air to provide in effect a large, bright, radiant heat bubble directly over the load in the kiln with spectacular results. The temperature of the clinker zone of an upset kiln which is at 2200° F. when driven according to the invention with an annulus tip pressure at 250 PSI has been observed to quickly increase in temperature to 2600° F. by mere increase in the annulus fuel pressure to 800 PSI.

The invention has now been described with reference to specific embodiments. Other embodiments will be apparent from this disclosure to those of ordinary skill in the art. It is therefore not intended that the invention be limited except as indicated by the appended claims.

What is claimed is:

1. A liquid fuel fired burner assembly for producing a single variable shaped asymmetric flame, said assembly comprising:

a tip head for receiving and carrying tip means in relatively fixed, spaced-apart relation, said tip head including means defining a hollow core for receiving a first fuel supply and means defining a hollow annulus about said hollow core for receiving a second fuel supply;

a first fuel supply means for controllably supplying liquid fuel to a first tip means through said core;

a second fuel supply means for controllably supplying liquid fuel to a second tip means through said annulus;

first liquid fuel spray tip means mounted to said tip head and disposed parallel to a central axis of said burner assembly for forming a first dispersed liquid fuel spray cone having its axis parallel to said central axis of said burner;

second liquid fuel spray tip means mountable to said tip head for forming a second dispersed liquid fuel spray cone, said second tip means being disposed divergent of said central axis on one side of a plane through said axis, and wherein the spray cone angle of said second tip means is substantially wider than the spray cone angle of said first tip means such that said second spray cone substantially intersects said first spray cone to form a single composite liquid fuel spray cone of asymmetric cross-section relative to said plane; and means for controlling the relative rates at which said first fuel supply means and said second fuel supply means provide liquid fuel to said core and to said annulus, respectively, such that the asymmetric shape of said single composite liquid fuel spray cone may be continuously varied.

2. Apparatus according to claim 1 wherein said second liquid fuel spray tip means define a spray cone angle of at least about 60° and less than about 100° to produce liquid fuel droplets of a minimum size for producing localized head "polishing".

3. Apparatus according to claim 1 wherein said second tip means is oriented at an angle of between about 40° and 70° to said central axis for supplying a maximum concentration of liquid fuel droplets along a path transverse of the central axis to a lateral target area forward of said tip head.

4. Apparatus according to claim 1 wherein said tip head is bilaterally symmetric along a plane through said central axis, said tip head further comprising at least two means for receiving said second tip means disposed at spaced locations equidistant from said plane.

5. Apparatus according to claim 4 wherein said tip head further comprises means for receiving and carrying at least three first tip means disposed at spaced locations equidistant from said central axis.

6. Apparatus according to claim 1 wherein said first and second fuel supply means comprises a pair of concentric tubular conduits defining a first fuel path interior of the inner of said conduits and a second fuel path in the annular region between said pair of conduits, and a plurality of conduits interior of said tip head communicating from the first and second fuel paths to the first and second fuel tip means respectively.

7. A method for producing a single asymmetric liquid fuel flame from a burner assembly having first and second independently controllable supply means and first and second fixed, divergent fuel injection tip means spaced equidistant from a central axis through said burner assembly, said method comprising the steps of:

(a) injecting at least one stream of liquid fuel from said first supply means through said first tip means as a first combustible spray cone along an axis parallel to said central axis;

(b) injecting at least another stream of liquid fuel from said second supply means through said second tip means as a second combustible spray cone divergent of said central axis and on one side of a plane through said central axis, the cone angle of said second combustible spray being substantially greater than the cone angle of said first combustible spray such that a substantial portion of said second spray intercepts said first spray cone to form a single composite asymmetric fuel spray cone; and (c) independently controlling the relative rate of fuel supply of said first and second fuel supply means to said first and second tip means, respectively, so that the shape of the composite fuel spray cone can be continuously varied in an asymmetric pattern.

8. The method according to claim 7 wherein said second injecting step comprises injecting at least two off axis streams laterally symmetrical relative to a plane parallel to said axis.

9. The method according to claim 7 wherein the cone angle of said second sprays is between about 60° and 100° and the transverse angle of said second spray with said central axis is between about 40° and 70° for supplying a maximum concentration of droplets along a path transverse of said central axis to a lateral target area forward of said tip means.

* * * * *